United States Patent [19]

Gramstad

[11] 4,444,374

[45] Apr. 24, 1984

[54] PREFABRICATED CONCRETE FORMS ASSEMBLY

[76] Inventor: Selmer E. Gramstad, 217 11th Ave., SE., Rochester, Minn. 55901

[21] Appl. No.: 397,112

[22] Filed: Jul. 12, 1982

[51] Int. Cl.[3] ..... B28B 7/22

[52] U.S. Cl. ..... 249/14; 249/219 R

[58] Field of Search ..... 249/14, 219 R, 194

[56] References Cited

U.S. PATENT DOCUMENTS

| | | | |
|---|---|---|---|
| 1,036,025 | 8/1912 | Symons et al. | 249/219 R X |
| 1,164,335 | 12/1915 | Engstrom | 249/219 R X |
| 1,538,604 | 5/1925 | Thrasher et al. | 249/14 |
| 1,656,420 | 1/1928 | Christy et al. | 249/219 R X |
| 1,662,258 | 3/1928 | Wales | 249/219 R X |
| 2,610,380 | 9/1952 | Pollman | 249/3 |
| 3,284,042 | 11/1966 | Ingalise | 249/5 |
| 3,780,976 | 12/1973 | Messier | 249/14 |

*Primary Examiner*—Donald E. Czaja
*Assistant Examiner*—James C. Housel
*Attorney, Agent, or Firm*—Keith T. Bleuer

[57] ABSTRACT

A concrete forms assembly for casting a concrete stair and comprising two tiers of panels of sheet material, each panel being channel shaped in cross section. Each tier of panels comprises a pair of opposite side panels and a front panel bridging ends of the side panels, and the side panels of the second tier are shorter than the side panels of the first tier so as to leave an exposed space to define a first or intermediate step of the stair. Clips are swingably disposed on the upper flange of each of the side panels in the lower tier to engage with the lower flanges of the front panel in the second tier, and hooks are carried by the upper flanges of each of the side panels for connecting the upper flanges of the front panels to the front panels in the respective tiers.

2 Claims, 4 Drawing Figures

Fig. 2
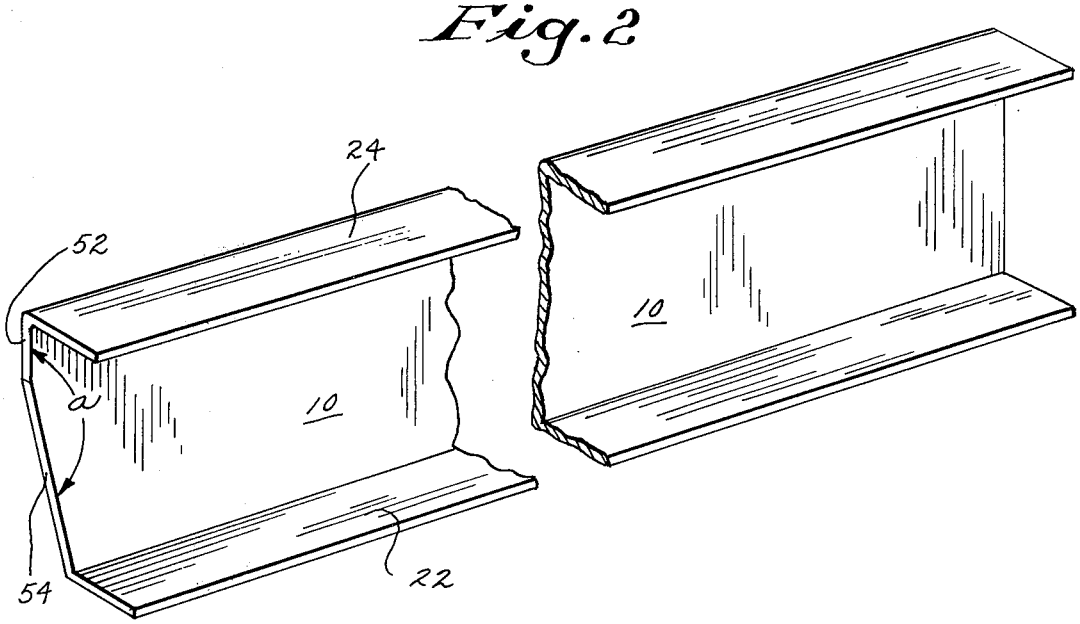
Fig. 3
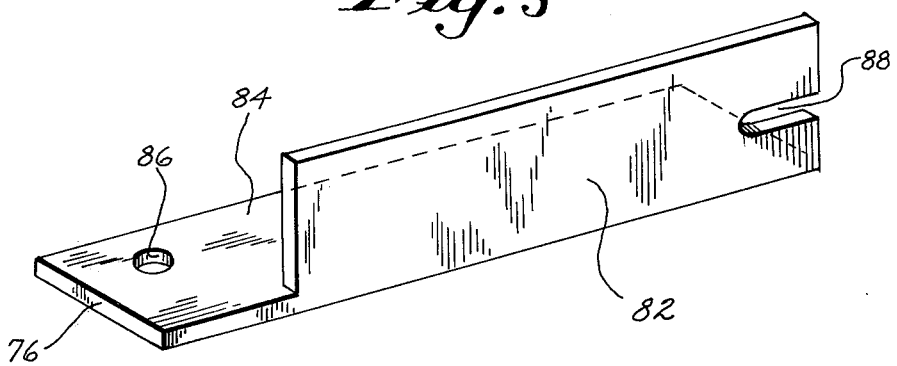
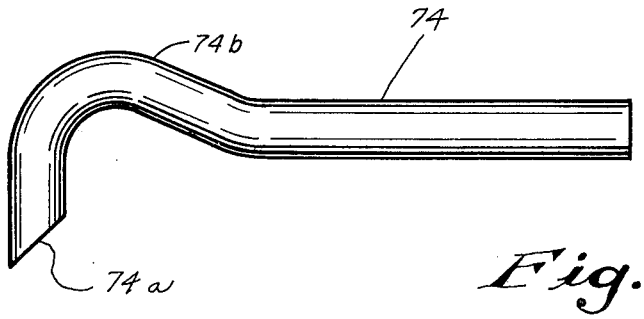
Fig. 4

PREFABRICATED CONCRETE FORMS ASSEMBLY

BACKGROUND OF THE INVENTION

The invention relates to forms for molding or casting fluent concrete in the desired shape of the completed concrete article and in particular to such forms which are particularly suitable for forming a concrete stair or steps.

It has previously been the practice to make the forms for molding concrete steps out of lengths of board, such as for example boards of one inch by six inches or eight inches in cross section. These boards have been cut into the lengths necessary for containing the fluent concrete in the form of a stair, with three lengths of board for example being used respectively for the two sides and front of a first or lowermost tier defining the lowermost or first step of the stair, and a second set of such boards defining a second tier and particularly the second step of the stair. The boards on the two sides of the second tier are shorter than the boards on the two sides of the first tier so that the first or intermediate step is defined. Stakes are placed at the sides of the tiers so as to hold the side boards from moving outwardly under the pressure of the fluent concrete, and stakes are also generally used at the front of the first tier to hold the fluent concrete from moving forwardly. The boards defining the two tiers are nailed to each other and also to the stakes for holding them in place.

After the concrete has set, the boards are hammered apart to separate them from the completed stair and from each other, and the lumber is generally discarded.

SUMMARY OF THE INVENTION

It is an object of the invention to provide a prefabricated stair forms assembly made up of a plurality of metal channels which are demountable and separable from each other and which are so attached together whereby they may be easily separated to again be used to make additional stair installations.

In a preferred form, the assembly comprises a pair of side panels in the form of channels and a front panel also in the form of a channel which is connected to the side panels by means of hooks for forming a first tier that in effect provides the first or intermediate step of the stair and another such set of side panels and a front panel resting on the previously mentioned panels but with the side panels being shorter than the side panels of the first tier so as to thereby provide a second tier that may provide the second step or the top platform of the stair.

BRIEF DESCRIPTION OF THE DRAWINGS

FIG. 2 is a side elevational view of one of the side panels;

FIG. 3 is a side elevational view of a swingable clip that is used for detachably connecting the front panel of the second tier with one of the side panels of the first tier; and FIG. 4 is a side elevational view of a hook that is used for connecting a front panel of one of the tiers with a side panel of that tier.

DESCRIPTION OF THE PREFERRED EMBODIMENT

Figure 1:
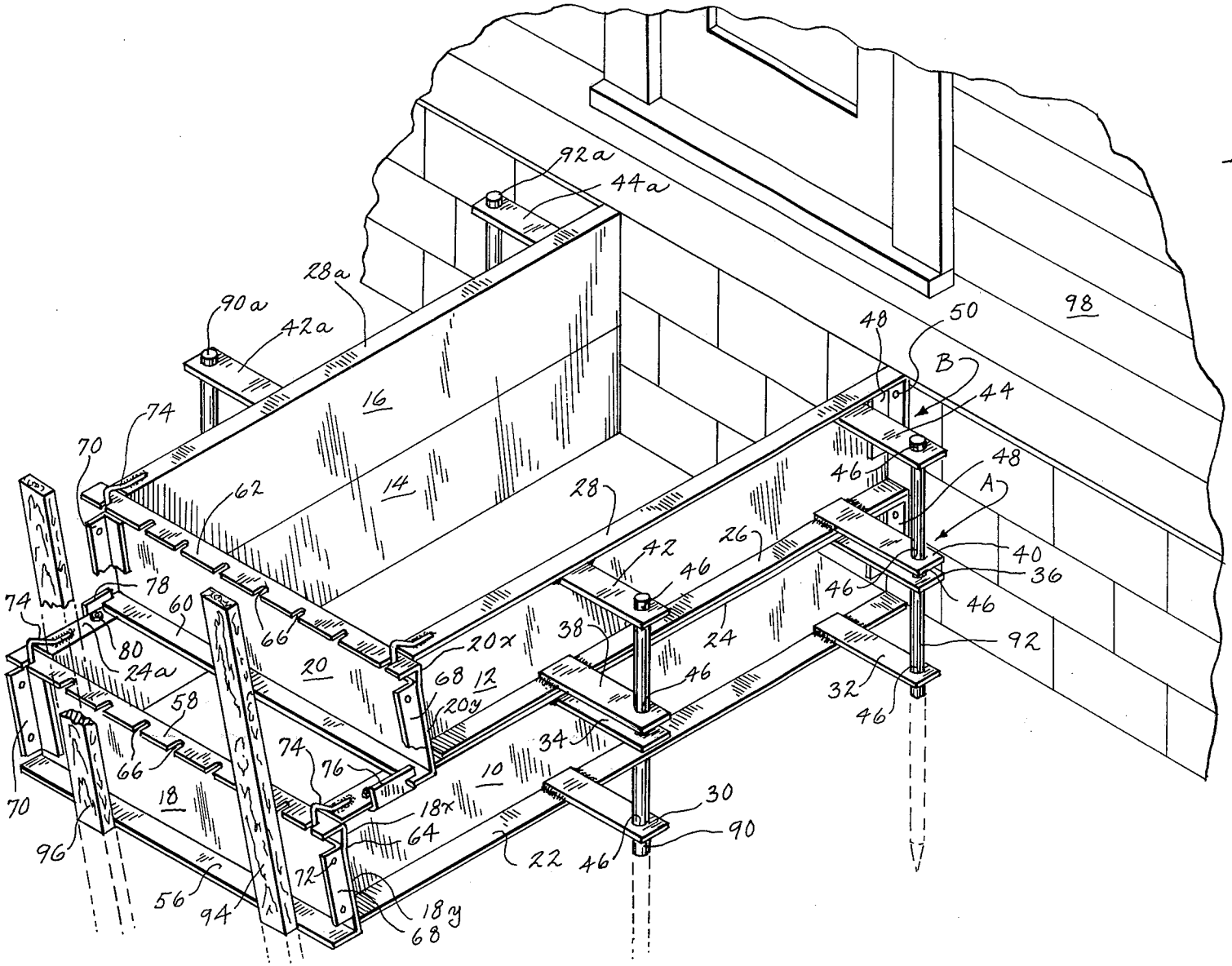
FIG. 1 is an isometric view showing the preferred form of the stair forms assembly of the invention which includes two tiers of panels each comprising a pair of opposite side panels and a front panel.

Referring to FIG. 1, the adjustable stair forms assembly illustrated may be seen to comprise right side panels 10 and 12, left side panels 14 and 16, and front panels 18 and 20. The panel 10 is formed with lower and upper sidewardly extending flanges 22 and 24, and the panel 12 is formed with similar flanges 26 and 28. The panels 14 and 16 are formed with similar flanges extending to the left instead of the right and including flanges **24*a* and 28*a* visible in FIG. 1. Outrigger strips 30 and 32 are welded to the upper surface of the flange 22, and similar outrigger strips 34 and 36 are welded to the lower surface of the flange 24. Outrigger strips 38, 40, 42, and 44. which are similar to the previously mentioned strips, are welded to the upper surface of flange 26 and the lower surface of flange 28 as shown. Each of the outrigger strips has an opening 46 through it. The panel 12 is vertically stacked on the panel 10 as shown in FIG. 1, with the flanges 24 and 26 in alignment; and the outrigger strips 30, 34, 38, and 42 are in vertical alignment, with their openings 46 also in vertical alignment. Likewise, the strips 32, 36, 40, and 44 are in vertical alignment, and their openings 46 are in vertical alignment. For this purpose, the strips 32, 36, 40, and 44 may be positioned approximately six inches from the right ends of the panels 10 and 12; and the strips 30, 34, 38, and 42 may be positioned approximately 26 inches from the right ends of these panels. Outrigger strips similar to those just described for the panels 10 and 12 are welded to the flanges of the panels 14 and 16, and the outrigger strips 42*a* and 44*a* on panel 16 corresponding to the outrigger strips 42 and 44 are shown in FIG. 1**.

Angle iron end clips 48, each having an opening 50 through a plate portion thereof that extends at right angles to the panels 10, 12, 14, and 16 are welded to these panels at their right ends, the clips 48 on the right ends of the panels 10 and 12 being illustrated in FIG. 1. Each of the panels 10, 12, 14, and 16 is formed at its outer ends with edge portions 52 that extend for a short distance downwardly, perpendicularly to the upper flanges on these panels, and with edge portions 54 that slope obliquely downwardly toward the right ends of the panels. These edge portions 52 and 54 are shown particularly on the panel 10 in FIG. 2. Each of the edge portions 52 may for example be one inch long while the panels are 7 inches high and while the lower edge of the panel is set back one inch for example from vertical. Thus the angle a between the edge portions 52 and 54 may be the supplement of an angle whose tangent is 1/6, the angle a thus being 170.5 degrees. Incidentally, the panels 10 and 14 may each for example be 5 ft. long measured along their upper flanges; and the panels 12 and 16 may be one foot shorter, or 4 ft. long, for example. The panels 10, 12, 14, and 16 may be for example of 11 gauge metal with two inch flanges. The flanges 22, 24, 26 and 28 for the panels 10 and 12 for example extend at 90 degree angles wtih respect to the flat surfaces of the panels. The front panel 18 may be of the same material as the panels 10, 12, 14 and 16 and is formed with a bottom flange 56 and a top flange 58. The panel 18 is bent along a longitudinal line 64 so that the panel 18 has a longitudinal strip or portion **18*x* that is perpendicular to the flange 58 and has a lower longitudinal strip 18*y* that extends obliquely therefrom. These strips match the edges 52 and 54 and have the same angle a (of 170.5 degrees, for example) between them (see FIG. 2**).

The bottom flange 56 extends parallel with the flange 58 and is thus at the acute angle of a - 90 degree with respect to the panel strip 18*y*. The upper flange 58 is provided with slots 66, and end clips 68 and 70 are welded to the panel 18 at its ends and particularly on the strip 18*y*. The clips 68 and 70 are right angular in cross section and have openings 72 in portions of them that extend at right angles to the strip 18*y*. The construction of the panel 20 is similar to that of the panel 18 as just described including the slots 66, end clips 68 and 70 and bend line 64.

Hooks 74 are welded on the upper surfaces of the flanges 24, 28, 24*a* and 28*a* as is shown in FIG. 1. One of the hooks 74 is shown in FIG. 4; and, as will be noted, the hook has a beveled end 74*a* and has an intermediate upwardly extending hump 74*b*. The hooks enter the slots 66 as will hereafter appear. Clips 76 and 78 are swingably mounted on the undersurfaces of the flanges 24 and 24*a* by means of bolts 80 that extend loosely and untightened through aligned openings in these parts. The clip 76 is shown in detail in FIG. 3, and it will be observed that the clip 76 has two flanges 82 and 84 at right angles to each other. The opening 86 for the corresponding bolt 80 extends through the flange 84, and the flange 84 is located on the undersurface of the flange 24. A slot 88 is provided in the end of the flange 82, and the slot 88 receives the flange 60 as will hereafter appear. The clip 78 is of similar but reversed construction.

Rod-like stakes 90 and 92 extend through the aligned openings 46 of the outriggers and are used for holding the panels 10 and 12 in vertically stacked alignment. Stakes 94 and 96 brace the panel 18. Due to the obliquely extending strip 18*y* of the panel 18, the edge of the flange 56 lies underneath the edge of the flange 58, and the stakes 94 and 96 are thus slanted with respect to vertical so that the stakes contact the edges of both flanges 56 and 58 for bracing the panel 18. Corresponding rod-like stakes 90*a* and 92*a* extending through the outrigger strips 42*a* and 44*a*, for example, are used for holding the panels 14 and 16 in vertical alignment. The clips 48 on the right ends of the panels 10, 12, 14, and 16 are used for attaching the right ends of these panels to the side of a building 98 on which the concrete stair is to be placed.

In putting the forms assembly into place, the panels 10 and 14 are first put into proper positions parallel to each other and with their right ends in contact with the side of the building 98. Then the front panel 28 may be moved into place with the two hooks 74 on flanges 24 and 24*a* entering slots 66 in the front panel. This may be particularly accomplished by first putting the upper edge of the panel 18 into contact with the ends of the panels 10 and 14, with the lower edge of the panel 18 being substantially spaced from the lower edges from the panels 10 and 14, and then moving the lower part of the panel 18 and its flange 56 toward the building 98 so as to bring the strip portion 18*y* into contact with the edge 54 of the panel 10 and the corresponding obliquely extending edge of the panel 14. The humps 74*b* in the hooks 74 allow this pivoting motion of the panel 18 into position without binding. Since the strips 18*x* and 18*y* extend at the same angle a with respect to each other as do the edges 52 and 54 of the panel 10 for example, the panel 18 closes the compartment provided by the side panels 10 and 14 and forms a completed enclosure or form in a tier A for a lower concrete step. Alternately, instead of moving the front panel 18 into contact with the ends of the panels 10 and 14, the front panel 18 may first be put into position and then the panels 10 and 14 may be moved downwardly so as to bring the edges 52 and 54 of the panels 10 and 14 into contact with the panel strips 18*x* and 18*y* and with the hooks 74 being moved downwardly into a pair of the slots 66. The beveled hook ends 74*a* help the hooks 74 to move into the proper slots 66 with this mode of assembly. The end result of a completed enclosure in tier A for the lowermost step is the same.

After the panels 10, 14, and 18 have been so properly positioned, the panels 12, 16, and 20 may be positioned on top of the panels 10 and 14 to form a second or uppermost tier B. The panel 12 may be positioned in vertically stacked alignment on the panel 10 by positioning the flange 26 on the flange 24, and the panel 16 may in the same manner be placed in vertical alignment on the panel 14. The clips 76 and 78 have been swung outwardly on their bolts 80 away from the flanges 24 and 24*a*, and the panel 20 may be moved into position by first moving its upper edge into contact with the upper edges 52 of the panels 12 and 16, with the panel 20 extending forwardly to some extent, aligning a pair of the slots 66 in the flange 62 with the hooks 74 welded to the upper flanges 28 and 28*a*, and then rotating the bottom portion of the panel 20 so as to bring the longitudinal strip portion 20*y* into contact with the edge portions 54 of the panels 12 and 16 so that the edges 52 and 54 of the panels 12 and 16 are in contact with the strip portions 20*x* and 20*y* of the panel 20. The clips 76 and 78 are then swung into their positions illustrated in FIG. 1 in which the flange 82 of the clip 76 for example is in contact with the edge of the flange 24 and in which the flange 60 is received within and is embraced by the sides of the slot 88 of the clip 76 and similarly in the corresponding slot of the clip 78. Under these conditions, the upper portion of the panel 20 is held in position and in contact with the edges 52 of the panels 12 and 16 by means of the hooks 74 on flanges 28 and 28*a*, and the lower portions of the panel 20 are held in contact with the edges 54 of the panels 12 and 16 by means of the clips 76 and 78. Alternately, instead of first placing the panels 12 and 16 in position on the panels 10 and 14, the panel 20 may be put into proper position and then the panels 12 and 16 may be moved downwardly so as to bring the hooks 74 carried by the panels 12 and 16 into the proper slots 66 of the panel 20.

With the panels 10 and 12 being vertically aligned and with the panels 14 and 16 being vertically aligned, and with the front panels 18 and 20 being held in their proper positions as illustrated in FIG. 1 closing the tiers A and B respectively, the forms assembly is in finished form. It is assumed that the right ends of the forms are attached to the building 98 by means of suitable screws or nails extending through the clips 48, and the panels 10, 12, 14 and 16 are fixed with respect to each other and with respect to the surface of the ground on which the stair is to be put by means of the stakes 90 and 92 for the panels 10 and 12 and corresponding stakes 90*a* and 92*a* for the panels 14 and 16. The slanted stakes 94 and 96 brace the front panel 18, and of course the front panel 20 is held against movement to the left as seen in FIG. 1 by means of the hooks 74 on flanges 28 and 28*a* and by means of clips 76 and 78. With the assembly as being so completed, the forms assembly may be filled with rocks and concrete, with the concrete of course being on the upper surfaces for casting the desired stair. The pressure from the fluent concrete as it is being poured is taken by the stakes 90, 92, 90*a*, etc. holding the panels 10, 12, 14, 16 and 18 in their proper places, together with the hooks 74 on the upper flanges 28 and 28*a* of the panels 12 and 16 and the clips 76 and 78 effective on the lower flanges 60 of the panel 20. The hooks 74 fitting in respective slots 66 act to prevent the forward ends of the panels 10, 12, 14, and 16 from bulging outwardly, and the clips 76 and 78 act to prevent forward and upward movement of the panel 20 particularly since the flange 84 and the corresponding flange of the clip 78 are below and supported by the flanges 24 and 24*a*.

The clips 68 and 70 are useful when the steps is to be formed in a corner of a building having two exterior walls extending at right angles to each other; and, in this case, screws may be run through either the clips 68 into an adjacent wall of a building or through clips 70 into a wall of a building adjacent to the panels 14 and 16.

The fluent concrete restrained by the forms 10, 12, 14, 16, 18 and 20 may be finished in accordance with conventional practice. The uppermost step or platform may be preliminarily flattened and formed by drawing a straight edge along the uppemost flanges 28 and 28*a*, and this surface may then be troweled smooth. The intermediate step is formed by the front panel 18 and parts of the side panels 10 and 14, and this may also be roughly preliminarily formed and troweled smooth. The forms may be removed from the stair after the concrete has hardened by swinging the clips 76 and 78 outwardly away from the panels 10 and 14, then removing the front panel 20 by movements just reverse to those used in installing the panel 20, namely, by swinging the lowermost part of the front panel 20 outwardly to detach it from the hooks 74 on the flanges 28 and 28*a*, and then forcing the side panels 12 and 16 apart. The panels 10, 14 and 18 may then be removed in the same manner including swinging the front panel 18 outwardly at its lower edge (assuming that the stakes 94 and 96 have previously been removed). This detaches the front panel 18 from the side panels 10 and 14, and the side panels may be forced outwardly to remove them. It is assumed that any screws through the clips 48 attaching the panels 10, 12, 14 and 16 to a building as well as any passing through the clips 68 and 70 have been removed.

Due to the angles a between the panel portions 18*x* and 18*y* and the panel portions 20*x* and 20*y* and the angles a between the edges 52 and 54 on the ends of the panels 10, 12, 14 and 16, there is a setback (such as of 1 inch) making for a stair that is easy to use and does not cause undue tripping by a person using the stair. The completed stair is considerably more attractive than one that is formed by the use of lumber forms in view of the fact that each of the panels has a height which is just the height of a completed step.

The forms making up the forms assembly may be used many times, such as 6 to 100 times, before requiring replacement. This may be contrasted with the use of lumber forms which hardly ever permit of usage a second time for the basic lumber. The forms assembly of the invention thus saves the price of themselves, even though their first cost may be greater than the wood required for the same steps; and the assembly is much easier and less time consuming than for a forms assembly made up of wood. Such a forms assembly as disclosed herein can be put together in less than one half hour and may be removed from the completed work in less time than that. The panels may be oiled, and thus they do not contain after usage old concreted material which would tend to prevent their reuse. There is no cutting and wastage of lumber, which can be quite expensive, for the construction of steps using the described forms assembly. The oiled metal panels make for very little, if any, honeycombing, and stripping the forms from the completed steps is much easier than with the usual lumber forms. The forms assembly of the invention thus solves problems in both the labor and material required; and in addition, the completed steps produced with the stair forms assembly described also is very attractive in appearance.

Although in the forms assembly as shown in FIG. 1, the front panels 18 and 20 are of the exact length required for the concrete steps being constructed, it will be understood that actually these front panels 18 and 20 may be considerably longer to accommodate themselves to the subsequent formation of steps that are considerably wider. Although only the two tiers A and B of panels are illustrated in FIG. 1 for the formation of only one intermediate step plus a top platform, with the tier A including the panels 10, 14 and 18 and the top tier B including the panels 12, 16 and 20, it will be understood that additional tiers of panels may be used for forming higher stairs with more steps. An additional tier would include the same panels as those used for the tier B except that the side panels of the additional tier would be shorter than the panels 12 and 16 by the width of the second intermediate step to be formed. The panels of the additional tier would be attached together and to lower panels in the same manner as has been described for the tier B.

I claim:

1. A prefabricated concrete forms assembly comprising a first pair of spaced parallel oppositely disposed side panels, a first front panel bridging front opposite ends of said side panels, a second pair of side panels respectively vertically stacked on said first side panels and being of shorter lengths than said first side panels so as to leave front portions of said first side panels exposed, a second front panel bridging front opposite ends of said second pair of side panels, each of said panels having upper and lower outwardly extending flanges, means detachably connecting the lower edge of said second front panel to upper parts of the respective ones of said first side panels, and means for detachably connecting upper parts of said first and said second pair of side panels to upper parts of the respective ones of said front panels bridging the respective side panels so that the assembly defines an enclosure for receiving fluent concrete, said means detachably connecting the lower edge of said second front panel to upper parts of the respective ones of said first side panels including a clip swingably mounted on the upper flange of each of said first side panels by means of a pin-like part extending through the clip and through the respective upper flange and being of just sufficient length so that when swung to bring its remote end at the closest distance toward said second front panel it holds said second front panel in contact with the adjacent front ends of said second pair of side panels, said means detachably connecting upper parts of said side panels to upper parts of the respective front panels comprising a hook on each of said side panels, each of said hooks having parts substantially at right angles to each other with one of said parts of each hook being fixed on to the upper flange of each of said side panels and the other part extending downwardly along the respective front panel and having a length substantially less than the height of the front panel to extend for substantially less than the height of the front panel.

2. A prefabricated concrete forms assembly as set forth in claim 1, each of said hooks having an upwardly extending bulge between its said two parts to allow the adjacent front panel to be swung in place on the ends of the adjacent side panels and the upper flange of said adjacent front panel having a notch for receiving each of said hooks, each of said clips having a flange portion beneath the upper flange on which the clip is mounted to hold the clip from upward movement and having a notch for receiving the lower flange of the adjacent front panel on which the clip is effective.

* * * * *